US008371311B2

(12) United States Patent
Gueret

(10) Patent No.: US 8,371,311 B2
(45) Date of Patent: Feb. 12, 2013

(54) PACKAGING ASSEMBLY COMPRISING A MODULATED MAGNETIZATION DEVICE

(75) Inventor: Charlotte Gueret, Paris (FR)

(73) Assignee: L'OREAL, Paris (FR)

( * ) Notice: Subject to any disclaimer, the term of this patent is extended or adjusted under 35 U.S.C. 154(b) by 440 days.

(21) Appl. No.: 12/643,437

(22) Filed: Dec. 21, 2009

(65) Prior Publication Data

US 2010/0156581 A1 Jun. 24, 2010

Related U.S. Application Data

(60) Provisional application No. 61/141,313, filed on Dec. 30, 2008.

(30) Foreign Application Priority Data

Dec. 23, 2008 (FR) ..... 08 59006

(51) Int. Cl.
*A45D 40/26* (2006.01)
*A46B 11/00* (2006.01)

(52) U.S. Cl. ..... 132/218; 401/129

(58) Field of Classification Search ..... 132/218, 132/73.5; 401/122, 126–130
See application file for complete search history.

(56) References Cited

U.S. PATENT DOCUMENTS

| | | | | |
|---|---|---|---|---|
| 6,292,078 | B1 * | 9/2001 | Cardone et al. | 335/295 |
| 2007/0125396 | A1 * | 6/2007 | Ramet | 132/73.5 |

FOREIGN PATENT DOCUMENTS

| | | |
|---|---|---|
| EP | 1 493 590 | 1/2005 |
| EP | 1 759 610 | 3/2007 |
| WO | 2006/037900 | 4/2006 |
| WO | 2006/054002 | 5/2006 |
| WO | 2008/046702 | 4/2008 |

* cited by examiner

*Primary Examiner* — Robyn Doan
(74) *Attorney, Agent, or Firm* — Oblon, Spivak, McClelland, Maier & Neustadt, L.L.P.

(57) ABSTRACT

An assembly includes a container that contains a fluid composition having magnetic substances and a magnetization device that makes it possible to produce a pattern on a substrate onto which said composition has been deposited, the magnetization device including a holder and two magnets, at least one of which is in the form of a flexible sheet, the two magnets being at least partially superposed so that the field lines that they generate in combination with one another result from the interference between the field lines of each of the magnets.

17 Claims, 4 Drawing Sheets

PACKAGING ASSEMBLY COMPRISING A MODULATED MAGNETIZATION DEVICE

CROSS REFERENCE TO RELATED APPLICATIONS

This document claims priority to French Application Number 08 59006, filed Dec. 23, 2008 and U.S. Provisional Application No. 61/141,313, filed Dec. 30, 2008, the entire contents of each which are incorporated herein by reference.

FIELD OF THE INVENTION

One subject of the present invention is an assembly that can be used for decorating a substrate. In particular it finds a use in the field of cosmetic products where the consumers of these products desire to obtain different makeup effects without however multiplying the number of different compositions necessary in order to obtain these effects. The invention can also be applied to the field of packaging where different decorations are desired from a limited number of means and by limiting the number of changes to be carried out on the production lines of said packages.

BACKGROUND OF THE INVENTION

Discussion of Background

The expression "cosmetic product" is understood to mean a product as defined in Council Directive 93/35/EEC of 14 Jun. 1993.

A composition is known from document WO2006/037900 that contains magnetizable substances placed in an assembly comprising means for depositing a quantity of this composition onto a substrate and then subjecting it to a magnetic field, in order to set an orientation of the magnetizable substances in the composition deposition as the composition itself sets.

An improvement of such a type of assembly is also known from document EP 1 759 610.

In an entirely different field of application, outside of the cosmetic field, document WO 2008/046702 describes a method and means for producing a pattern on a banknote using magnetic particles that are oriented during their deposition on the banknote.

SUMMARY OF THE INVENTION

The objective of the present invention is to obtain a plurality of decorative effects from one composition to be spread, which intrinsically does not have the desired decorative effect when it is spread, but which may be made to exhibit it when it is subjected to a magnetic field. For this purpose, the present invention targets an assembly comprising the composition to be spread contained in a container and a modulated magnetization device. Advantageously, the magnetization device may be modulated so that it can provide at least two patterns of distinct magnetic field lines.

One subject of the invention is an assembly comprising a container that contains a fluid composition comprising magnetic substances and a magnetization device that makes it possible to produce a pattern on a substrate onto which said composition has been deposited, this magnetization device comprising a holder and two magnets, at least one of which is in the form of a flexible sheet, the two magnets being at least partially superposed so that the field lines that they generate in combination with one another result from the interference between the field lines of each of the magnets, characterized in that the magnetization device comprises a concave front face.

The magnets according to the invention exhibit a remnant and/or permanent magnetization in the absence of a magnetic field.

The expression "flexible sheet" is understood to mean a structure having a small thickness relative to its width and length dimensions. This structure can be deformed on exerting a manual strain. In particular this structure can be deformed in at least one dimension, namely it may be deformed manually in its length or in its width.

The advantage of the flexible sheet is that it can be easily shaped into different positions and thus modify the field lines that it generates in a plane.

The advantage conferred by such an embodiment of the magnetization device is understood when it is compared, in its manufacturing process, to that of solid magnets made of pure ferrite or of rare earth.

Indeed, such solid magnets are difficult to shape. They are not adaptable. The patterns proposed by the solid magnets, once finalized, cannot themselves be modified either. Furthermore, they are expensive to produce since they require the use of several steps, and especially the magnetization step of the ferrite by a magnetizing head is very expensive. Indeed, the only magnetizing heads capable of magnetizing solid substrates are made of copper wire. However, it is necessary to replace these magnetizing heads regularly since the rates and temperatures to which they are brought lead to melting of the copper wires, and to the loss of the desired magnetization pattern. These magnetizing heads are subjected to high thermal and mechanical stresses.

The magnets in flexible sheet form are laminated in sheets and/or rolls and may be magnetized after the lamination, whilst the material intended to form the sheet is changing from the liquid to solid state. The magnetizing heads used are less delicate. These flexible sheets may be polarized on one or both opposite faces of the sheet.

The flexible sheets can be deformed and consequently can be adapted to the shape of the substrate to be decorated, especially when the substrate has curved surfaces.

In particular, the concave front face of the magnetization device is particularly adapted to the natural concavity of a nail to be made up, in order to obtain a pattern over the entirety of the surface of the nail. Similarly, it is possible to use such magnetization devices according to the invention for the finishing of packaging having rounded surfaces.

Similarly again, the magnetization devices according to the invention are particularly useful for making up curved parts of the body, such as the lips, the cheeks or any other surfaces of volume jutting out from the body.

For example, the magnet in the form of a flexible sheet may form a front face of the magnetization device intended to be placed closest to the substrate.

In particular, it is possible to choose to position the magnet of lower magnetic power among the two magnets so that it forms a front face of the magnetization device intended to be placed closest to the substrate. Such an arrangement is advantageous for enabling the weakest magnet to have a visible interference in the pattern resulting from the interference between the field lines of each of the magnets.

For example, the concave front face of the magnetization device may comprise at least one peak where the radius of curvature is between 4 and 20 mm, in order to provide field lines that are also concave and thus to enable a uniform formation of a pattern on a substrate which might be convex.

Advantageously, the radius of curvature of the concave front face is chosen so that it is complementary to the convex substrate to be decorated.

In particular, the two magnets may be attached to one another and their respective position may be set. For example, the two magnets may be immobilized relative to one another. For example, they are bonded together by a film having two adhesive opposite faces.

In particular, the two magnets may be arranged so as to allow modifications of the field lines that they generate in combination with one another, one of the two magnets being movable relative to the other of the magnets.

For example, a first magnet is held at a fixed position relative to the holder of the magnetization device. A second magnet of the magnetization device may be movably mounted about an axis of rotation relative to the holder and/or may be translatably movably mounted relative to said holder.

The holder may comprise a fastening means in order to be retained on the container comprising the composition. Thus, the handling of the assembly may be facilitated. For example, in the case where the container is a bottle equipped with a neck, then the holder may comprise an opening in order to fit around the neck. In the case where the assembly comprises an applicator mounted so as to be firmly attached to a closure member of the container, this closure member may cooperate with the magnetization device in order to keep it firmly attached to the container.

Preferably, an assembly according to the invention can be used for a substrate constituted by a nail, and in this case the holder may be adapted to receive said nail. For this purpose, the holder may comprise a first stop that forms a bearing zone for the end of this nail to be exposed to the magnetic field generated by the magnets of the magnetization device. As a variant, and/or in addition, when the substrate is a nail, the magnetization device may comprise a second stop in order to come to bear on the top of the finger, when the nail is exposed to the magnetic field generated by the magnets. The positioning of the nail relative to the magnetic field can thus be better controlled, and it is thus possible to avoid the contact of the nail covered with the composition with the magnetization device.

For example, one of the magnets of the magnetization device may be multipolar. The term "multipolar" is understood to mean a structure which comprises several zones that generate a magnetic field and that are spaced apart from one another.

Advantageously, the two magnets may both be in flexible sheet form and/or be multipolar.

According to one preferred embodiment, the magnet in the form of a flexible sheet may be formed by the inclusion of magnetized particles in a sheet made from a thermoplastic or from a resin. The magnetized particles may be chosen from the list defined hereinbelow for the magnetic substances. For example, the magnetized particles may be unipolar ferrite particles. When the material is a resin, this material may be an elastomer. In particular, the magnetized particles may be arranged so as to form straight lines, optionally parallel to one another, in the sheet.

For example, the two magnets may be identical. Advantageously, they are chosen to be of different magnetic power. The two magnets may both be in flexible sheet form and be multipolar.

In the case where the two magnets are sheets that create magnetic field lines that are parallel to one another, then depending on the position of a first sheet relative to the second sheet, either the field lines respectively created remain parallel to one another, optionally by being superposed, or else they cross one another. When a formulation containing magnetic substances is applied to a substrate, these magnetic substances will orientate themselves and regroup along the field lines in order to create a pattern on the substrate which is the replica of the field lines of the magnetization device.

Advantageously, use is made of an assembly according to the invention in a method for decorating a substrate that comprises the following steps:

- a film of fluid composition is deposited on the substrate, the substrate possibly being a keratin material, for example a nail, the skin or a mucosa, such as a lip, or else a part intended to form packaging, for example primary or secondary packaging made of paper, board, glass or plastic of said assembly according to the invention; and
- the film deposited is subjected to the magnetic field generated by the magnetization device before solidification of the film.

In the case where the method is used to form a pattern on packaging of the assembly according to the invention, then preferably this pattern reproduces the pattern generated by at least one of the magnetization devices of said assembly.

For example, the magnet in the form of a flexible sheet may be previously embossed before its incorporation into a magnetization device of an assembly according to the invention. It is, in this case, deformed in its thickness.

As should be apparent, the invention can provide a number of advantageous features and benefits. It is to be understood that, in practicing the invention, an embodiment can be constructed to include one or more features or benefits of embodiments disclosed herein, but not others. Accordingly, it is to be understood that the preferred embodiments discussed herein are provided as examples and are not to be construed as limiting, particular since embodiments can be formed to practice the invention that do not include each of the features of the disclosed examples.

BRIEF DESCRIPTION OF THE DRAWINGS

A better understanding of the invention will be gained from reading the following description in conjunction with the accompanying figures. The figures are offered purely as a guide and by way of example, and in no way limit the invention.

The invention will be better understood on reading the description which follows and on examining figures that accompany it. These are presented only by way of indication and are in no way a limitation of the invention. The figures show.

DETAILED DESCRIPTION OF THE PREFERRED EMBODIMENTS

Figure 1:
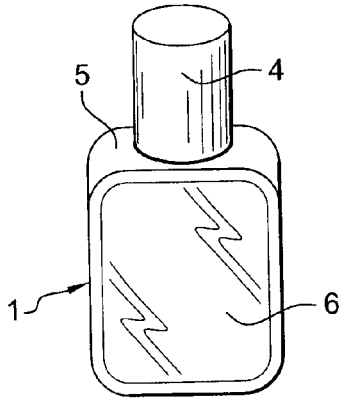
FIG. 1: a perspective front view of a container of an assembly according to the invention.

Referring now to the drawings, like reference numerals are utilized to designate identical or corresponding parts throughout the several views.

One subject of the present invention is an assembly for decorating that comprises a container 1 containing a fluid composition that comprises magnetic substances. The definition of magnetic substances is given hereinbelow. The fluid composition in which they are contained may be a cosmetic composition when, in particular, the making up of keratin materials is desired. The expression "keratin material" refers to the keratin materials of human beings, and encompasses keratin fibres, skin, integuments such as nails and mucosae such as the lips.

Figure 2:
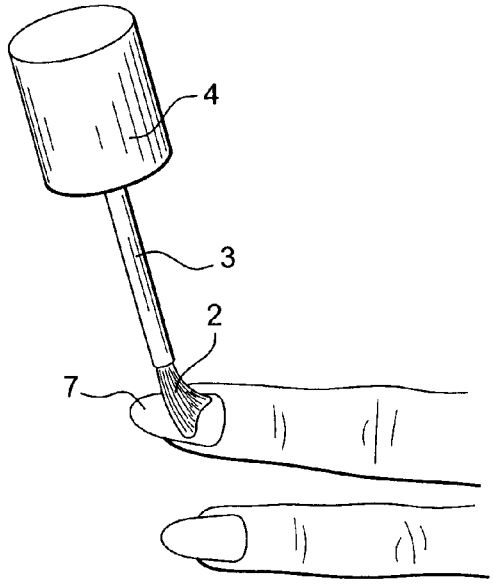
FIG. 2: a particular representation of the step of depositing a film of fluid composition onto a substrate to be decorated.

The composition is fluid, this definition covers any composition capable of being spread over a substrate. In particular, as is represented in FIG. 2, the assembly according to the invention comprises an applicator 2 for spreading the composition withdrawn from the container 1. In particular, the applicator is positioned at the end of a wand 3 in order to be dipped into the composition contained in the container 1. This wand 3 is retained such that it is firmly attached on the inside of a closure cap 4 of the container 1. In particular, an opening of the container 1, through which the composition may be withdrawn, is located at the end of a neck of said container 1.

The neck may correspond to a tubular zone, not represented, standing up from a shoulder 5 formed by the side walls 6 of the container 1. In particular, the neck may exhibit a relief, for example a thread, in order to cooperate with a complementary relief provided on the internal circumference of the closure cap 4.

When it is a question of applying a varnish to a nail 7, as is represented in FIG. 2, the applicator 2 is preferably a brush. When it is a question of applying a fluid foundation to the skin, the applicator 2 is preferably a spongy tip, such as a foam.

Magnetic Substances

The expression "magnetic substances" denotes substances exhibiting a non-zero magnetic susceptibility, that is to say, that are sensitive to the action of a magnetic field and tend, for example, to align along the field lines. The expression "magnetic substances" thus encompasses magnetizable substances.

Preferably, the magnetic substances used do not exhibit remanent magnetization in the absence of a magnetic field.

The magnetic substances can comprise any magnetic material exhibiting a sensitivity to the lines of a magnetic field, whether this field is produced by a permanent magnet or results from induction, this material being, for example, chosen from nickel, cobalt, iron, their alloys and oxides, in particular $Fe_3O_4$, and also gadolinium, terbium, dysprosium, erbium, their alloys and oxides. The magnetic material can comprise metallic iron, in particular soft iron which is optionally coated.

The magnetic substances may or may not exhibit a multilayer structure, comprising at least one layer of a magnetic material, such as, for example, iron, nickel, cobalt, their alloys and oxides, in particular $Fe_3O_4$.

The magnetic substances are preferably non-spherical, for example exhibiting an elongated shape. Thus, when these substances are subjected to the magnetic field, they tend to become orientated with their longitudinal axis in the alignment of the field lines and they undergo a change in orientation which is reflected by a change in appearance of the composition.

When the magnetic substances are substantially spherical, their appearance is preferably non-homogeneous, so that a change in orientation brings about a change in appearance.

The amount of magnetic substances is sufficient for the appearance of the composition to be able to depend on their orientation and/or on their location.

The concentration of magnetic substances is, for example, between approximately 0.05% and approximately 97% by weight, in particular between approximately 0.1% and approximately 95% by weight, better still between approximately 0.1% and approximately 90% by weight, for example of the order of 3% by weight. The size of the magnetic substances is, for example, between 1 nm and 700 μm, better still between 1 μm and 500 μm, even better still between 10 μm and 150 μm. The term "size" denotes the size that is given by the random particle size distribution at half the population, referred to as D50.

Magnetic Pigments

The magnetic substances of the composition may comprise magnetic pigments. Pigments which are very particularly suitable are pearlescent agents comprising iron oxide $Fe_3O_4$. Pigments exhibiting magnetic properties are, for example, those sold under the trade names Colorona Blackstar Blue, Colorona Blackstar Green, Colorona Blackstar Gold, Colorona Blackstar Red, Cloisonné Nu Antique Super Green, Microna Matte Black (17437), Mica Black (17260), Colorona Patina Silver (17289) and Colorona Patina Gold (117288) from Merck or alternatively Flamenco Twilight Red, Flamenco Twilight Green, Flamenco Twilight Gold, Flamenco Twilight Blue, Timica Nu Antique Silver 110 AB, Timica Nu Antique Gold 212 GB, Timica Nu Antique Copper 340 AB, Timica Nu Antique Bronze 240 AB, Cloisonné Nu Antique Green 828 CB, Cloisonné Nu Antique Blue 626 CB, Gemtone Moonstone G 004, Cloisonné Nu Antique Red 424 CB, Chroma-Lite Black (4498), Cloisonné Nu Antique Rouge Flambe (code 440 XB), Cloisonné Nu Antique Bronze (240 XB), Cloisonné Nu Antique Gold (222 CB) and Cloisonné Nu Antique Copper (340 XB) from Engelhard.

Mention may also be made of particles of black iron oxide sold by BASF or particles based on soft iron.

The magnetic substances may be fibres.

Magnetic Fibres

The term "fibres" denotes generally elongated substances exhibiting, for example, an aspect ratio ranging from 3.5 to 2500 or from 5 to 500, for example from 5 to 150. The aspect ratio is defined by the ratio L/D, where L is the length of the fibre and D is the diameter of the circle within which the greatest transverse cross section of the fibre is framed.

The transverse cross section of the fibres can be framed, for example, within a circle having a diameter ranging from 2 nm to 500 μm, for example ranging from 100 nm to 100 μm, indeed even from 1 μm to 50 μm.

The fibres can, for example, exhibit a length ranging from 1 μm to 10 mm, for example from 0.1 mm to 5 mm, indeed even from 0.3 mm to 3.5 mm.

The fibres can exhibit a weight ranging, for example, from 0.15 to 30 denier (weight in grams per 9 km of yarn), for example from 0.18 to 18 denier.

The fibres can have any shape in transverse cross section, for example circular or polygonal, in particular square, hexagonal or octagonal.

The composition can comprise solid or hollow fibres which are independent or connected to one another, for example plaited.

The composition can comprise fibres having ends which are blunted and/or rounded, for example by polishing.

The fibres may not experience a substantial modification in their shape when they are introduced into the composition, for example being initially rectilinear and sufficiently rigid to retain their shape. In an alternative form, the fibres may exhibit a flexibility which allows them to substantially change shape in the composition.

The fibres can comprise a non-zero content, which can range up to 100, of a magnetic material based on iron, on zinc, on nickel, on cobalt, or on manganese and their alloys and oxides, in particular $Fe_3O_4$, rare earths, barium sulphate, iron-silicon alloys, optionally comprising molybdenum, $Cu_2MnAl$, MnBi, or a mixture of these, this list not being limiting.

When the composition comprises fibres comprising magnetic particles, the latter can be present, for example, at least at the surface of the fibre, indeed even at the surface of the fibres only, inside the fibre only or also be dispersed within the fibre in a substantially homogeneous fashion.

The fibres can, for example, comprise a non-magnetic core with a plurality of magnetic particles at its surface.

The fibres can also comprise a synthetic matrix comprising a plurality of magnetic grains dispersed within it.

If appropriate, a synthetic material charged with magnetic particles can itself be coated with a non-magnetic shell. Such a shell constitutes, for example, a barrier which insulates the magnetic material or materials from the ambient medium and/or can introduce colour. The fibres can comprise a monolithic magnetic core and be coated with a non-magnetic shell, or the reverse case may apply.

The composition can comprise fibres produced by extrusion or coextrusion of one or more polymeric materials, in particular thermoplastics and/or elastomers. One of the materials extruded can comprise a charge of dispersed magnetic particles.

The fibres can comprise a synthetic material chosen from polyamides, PET, acetates, polyolefins, in particular PE or PP, PVC, polyester-block-amide, plasticized Rilsan®, elastomers, in particular polyester elastomers, PE elastomers, silicone elastomers, nitrile elastomers, or a mixture of these materials, this list not being limiting.

The composition can comprise composite fibres comprising a magnetic core at least partially coated with at least one synthetic or natural non-magnetic material. The coating of the magnetic core can be carried out, for example, by coextrusion, around the core, of a shell made of a non-magnetic material.

The coating of the core can also be carried out in another way, for example by in situ polymerization.

The core can be monolithic or can comprise a charge of magnetic grains dispersed in a matrix.

The composition can also comprise composite fibres obtained by coating a synthetic or natural non-magnetic core with a synthetic material charged with magnetic particles, the core being composed, for example, of a fibre made of wood, rayon, polyamide, a plant material, polyolefin, in particular polyethylene, Nylon®, polyimideamide or aramid, this list not being limiting.

The composition can also comprise magnetic composite particles, in particular a magnetic latex.

Magnetic Composite Particles

A magnetic composite particle is a composite material composed of an organic or inorganic matrix and of magnetic grains. The magnetic composite particles can thus comprise grains of a magnetic material at their surface and/or within them. The composite particles can be composed of a magnetic core coated with an organic or inorganic matrix, or vice versa.

The magnetic composite particles comprise, for example, one of the abovementioned magnetic materials.

The size of the magnetic composite particles is, for example, between 1 nm and 1 mm, better still between 100 nm and 500 μm, even better still between 500 nm and 100 μm. The term "size" denotes the size given by the random particle size distribution at half the population, referred to as D50.

The thesis by C. Goubault, 23 Mar. 2004, incorporated here by reference, gives, in chapter 1, a restatement of the state of the art with regard to magnetic composite particles and draws up a list of preparation processes which can be used to prepare magnetic composite particles, namely a separate synthesis of the magnetic grains and of the matrix, a synthesis of the magnetic grains in contact with the matrix or a synthesis of the matrix in the presence of the magnetic grains.

Magnetic composite particles with an inorganic matrix composed of silica are available commercially from Kisker. Magnetic composite particles with an organic matrix also capable of being used in the invention are provided by Dynal, Seradyn, Estapor and Ademtech.

More particularly, magnetic latices composed of ferrite grains uniformly distributed in a polystyrene matrix, this latex comprising 65% of iron oxide, the mean diameter of the polystyrene particles being 890 nm, and the content by weight on a dry basis being 10%, are available commercially from Estapor under the reference M1-070/60.

Ferrofluid

The composition can comprise a ferrofluid, that is to say a stable colloidal suspension of magnetic particles, in particular of magnetic nanoparticles.

The particles, with a size, for example, of the order of a few tens of nanometres, are dispersed in a solvent (water, oil, organic solvent), either using a surfactant or dispersing agent or by electrostatic interactions.

The ferrofluids are, for example, prepared by grinding ferrites or other magnetic particles until nanoparticles are obtained, which nanoparticles are subsequently dispersed in a fluid comprising a surfactant, which surfactant is adsorbed on the particles and stabilizes them, or by precipitation in a basic medium from a solution of metal ions.

Each particle of the ferrofluid exhibits a magnetic moment determined by the size of the particle and by the nature of the magnetic material.

Under the action of a magnetic field, the magnetic moments of the particles tend to become aligned along the field lines, with appearance of a non-zero magnetization in the liquid. If the field is cancelled, there is no hysteresis and the magnetization is reduced to zero.

Above a threshold field value, it is also possible to cause macroscopic changes in the liquid, for example the appearance of peaks or a modification in the rheological properties.

The name "ferrofluid" also encompasses an emulsion of droplets of ferrofluid in a solvent. Each drop then comprises colloidal magnetic particles in stable suspension. This makes it possible to have available a ferrofluid in any type of solvent.

The size of the magnetic particles in suspension in the ferrofluid is, for example, between 1 nm and 10 μm, better still between 1 nm and 1 μm, even better still between 1 nm and 100 nm. The term "size" denotes the size given by the random particle size distribution at half the population, referred to as D50.

Mention may in particular be made of the ferrofluids sold by Liquids Research Ltd under the references:

- WHKS1S9 (A, B or C), which is an aqueous-based ferrofluid comprising magnetite ($Fe_3O_4$), having particles with a diameter of 10 nm.
- WHJS1 (A, B or C), which is a ferrofluid based on isoparaffin and on magnetite ($Fe_3O_4$) particles with a diameter of 10 nm.
- BKS25_dextran, which is an aqueous-based ferrofluid stabilized by dextran, comprising magnetite ($Fe_3O_4$) particles with a diameter of 9 nm.

Chains of Magnetic Particles and/or Fibres

The composition may also comprise chains of magnetic particles and/or fibres.

The composition can thus comprise agglomerates of particles or fibres, the greatest size of which, for example the length, is, for example, between 1 nm and 10 mm, for example between 10 nm and 5 mm, or between 100 nm and 1 mm, or else between 0.5 μm and 3.5 mm, for example between 1 μm and 150 μm. The size denotes that given by the random particle size distribution at half the population, referred to as D50.

Chains of magnetic particles can be obtained, for example, by collecting together colloidal magnetic particles, as is described in the publications "*Permanently linked monodisperse paramagnetic chains*", E. M. Furst, C. Suzuki, M. Fermigier and A. P. Gast, Langmuir, 14, 7334-7336 (1998), "*Suspensions de particules magnétiques*" [Suspensions of Magnetic Particles], M. Fermigier and Y. Grasselli, Bulletin de la SFP (105) July 96, and "*Flexible magnetic filaments as micromechanical sensors*", C. Goubault, P. Jop, M. Fermigier, J. Baudry, E. Bertrand and J. Bibette, Phys. Rev. Lett., 91, 26, 260802-1 to 260802-4 (2003), the contents of which are incorporated by reference.

These papers describe in particular how to proceed in order to obtain chains of magnetic latex particles, comprising a polystyrene matrix comprising iron oxide grains, which particles are functionalized at the surface and are permanently bonded to one another following a chemical reaction, in particular via covalent bonds between the surfaces of the adjacent particles; a description is also given of a process for obtaining chains of droplets of ferrofluid emulsion bonded to one another via interactions of a physical nature. The length and the diameter of the permanent chains thus obtained can be controlled. Such magnetic chains constitute anisotropic magnetic objects which can be orientated and moved under the effect of a magnetic field.

The sizes of the magnetic chains can correspond to the same conditions as the magnetic fibres.

Example of a Fluid Composition

The composition may be a nail varnish or any other product to be applied to the skin, the integuments or the mucosae.

In particular, fluid compositions which may be used in an assembly according to the invention are described in document US 2006/0088484 incorporated here by reference.

For example, one particular composition for the implementation of the invention comprises the compounds indicated below in the following proportions.

| | % by weight |
|---|---|
| CITRIC ACID monohydrate | 0.06 |
| ALUMINIUM LAKE OF TARTRAZINE ON ALUMINA (26/74) (CI: 19140:1 + 77002) | 0.435 |
| CALCIUM LAKE OF LITHOL RED B ON BARIUM SULPHATE (60/40) (CI: 15850:1 + 77120) | 0.05 |
| LAMELLAR IRON PIGMENT, GRINDING WITH POPPY SEED OIL (90% PIGMENT - 10% SOLVENTS)/PARTICLE SIZE 18 μM | 1.25 |
| BLACK IRON OXIDE (CI: 77499) | 0.2 |
| SILICA/BROWN IRON OXIDE (CI: 77491) | 0.7 |
| SILICA/TITANIUM OXIDE/MICA/TIN OXIDE (35/40.5/24/0.5) (PARTICLE SIZE 10-60 μM) | 1.55 |
| NITROCELLULOSE AT 30% IN ISOPROPYL ALCOHOL (VISCOSITY: E22 - ½ S) (NITROCELLULOSE IDYL EMV IPA 30% from Bergerac) | 11.08 |
| NITROCELLULOSE AT 30% IN ISOPROPYL ALCOHOL (NITROCELLULOSE AZUR E80 IPA 30% from Bergerac) | 4.45 |
| PHTHALIC ANHYDRIDE/GLYCEROL/GLYCIDYL DECANOATE COPOLYMER IN ETHYL ACETATE AT 70% (BECKOSOL ODE 230 70 E from DAINIPPON INK & CHEMICALS) | 1.43 |
| PURE ISOPROPYL ALCOHOL | 3.14 |
| ETHYL ACETATE | qs for 100 |
| TRIBUTYL ACETYL CITRATE | 4.35 |
| N-ETHYL-O, P-TOLUENESULPHONAMIDE | 2.99 |
| N-PROPYL ACETATE | 17.42 |
| BUTYL ACETATE | 16.63 |
| HECTORITE MODIFIED WITH STEARYL BENZYL DIMETHYL AMMONIUM (BENTONE 27 V from ELEMENTIS) | 11.47 |
| Total | 100 |

Magnetization Device

The magnetization device 8 comprises, in FIG. 3, a holder 9 and two magnets 10 and 11 superposed one on top of the other so that the magnetic field lines that they generate respectively interfere with one another so as to define an overall pattern of field lines for said magnetization device 8.

Figure 3A:
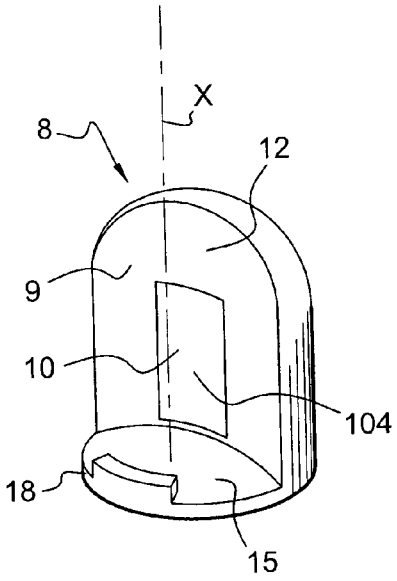
FIG. 3*a*: a perspective front view of a magnetization device of an assembly according to the invention.
Figure 3B:
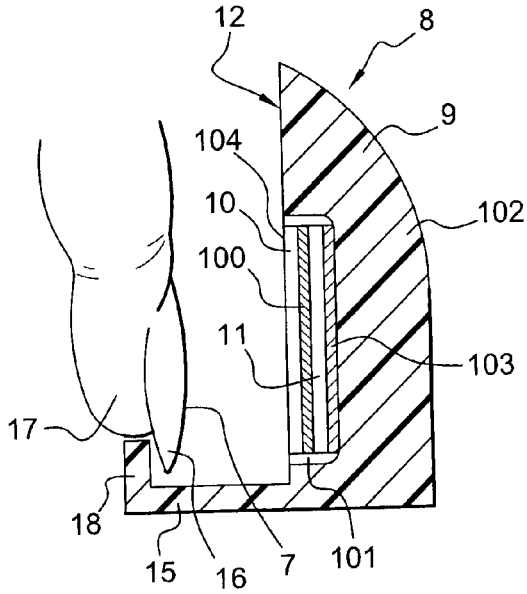
FIG. 3*b*: a view along a longitudinal cutting plane of FIG. 3*a;*

In FIG. 3*a*, the holder 9 comprises a wall 12 on which the two magnets 10 and 11 are arranged. The two magnets are bonded to one another by means of a first double-sided adhesive film 100 placed between them, which has, for example, a thickness of less than 1/10 mm. The wall 12 has a radius of curvature perpendicular to a main axis of extension X of the wall which is 10 mm. As can be seen in FIG. 3*b*, the wall 12 comprises a housing 101 configured so that the two magnets are held therein. They are, for example, held therein by means of a second adhesive film 102 bonded to the back 103 of this housing. In particular, the housing 101 is configured so that the two magnets can have a front face 104 which is profiled in the continuity of the face of the wall 12 defined around said housing 101. In this case then, the front face 104 of the magnets then has the same radius of curvature as the face 12.

The magnets are parallel to one face of this wall 12. In this example, the two magnets 10 and 11 are superposed and have substantially the same rectangular cross section. For example, one of the magnets covers the whole of the surface of the other of the magnets.

In FIGS. 3*a* and 3*b*, the wall 12 is joined to a second portion 15 that stands out substantially perpendicular to the wall 12. This second portion 15 has means that form a positioning stop for the substrate to be decorated. In the case where this substrate is a nail having at least one portion 16 that juts out from the flesh 17 located at the end of a finger, the second portion 15 comprises a relief 18 that forms a positioning stop in order to fit against a lower face of this nail portion 16. Preferably, this relief 18 stands out perpendicular to the second portion 15 and parallel to the wall 12. It has a height such that the flesh of the finger which is brought to a stop against the edge of this relief prevents contact between the nail and the second portion 15, for lengths of the nail portion 16 jutting out from the flesh of less than 0.5 cm.

Figure 4:
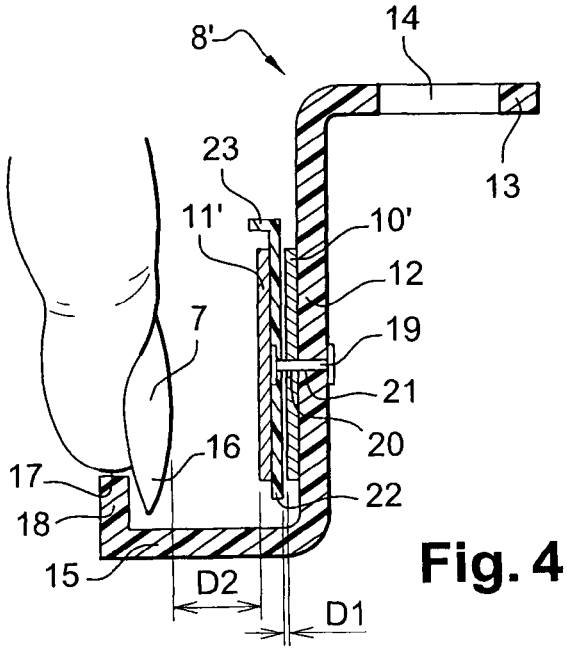
FIG. 4: a particular representation of the step of submitting a film deposited on the substrate to a magnetic field generated by a first embodiment variant of a magnetization device according to the invention before solidification of the film.

As is represented in FIG. 4, for a first embodiment variant of the magnetization device 8, this wall 12 is joined to a first portion 13 that stands out perpendicular to the wall 12. This first portion 13 comprises an opening 14, having a cross section that is big enough to be able to be fitted around the neck of the container 1.

Other means for fastening magnetization devices according to the invention to the container 1 may be envisaged.

The wall 12, the first portion 13 and the second portion 15 are obtained from a single part by moulding.

Figure 5:
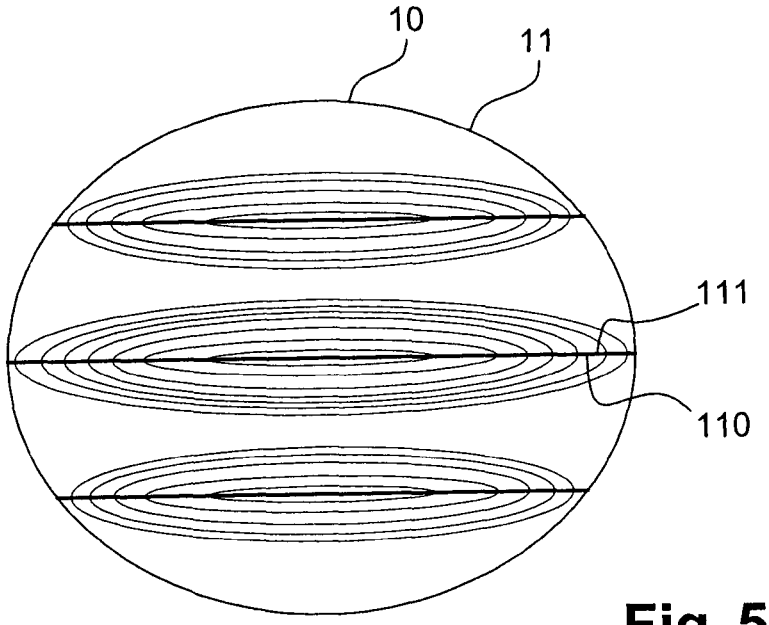
FIGS. 5 and 6: schematic top views of field lines generated by various magnetization devices of assemblies according to the invention.
Figure 6:
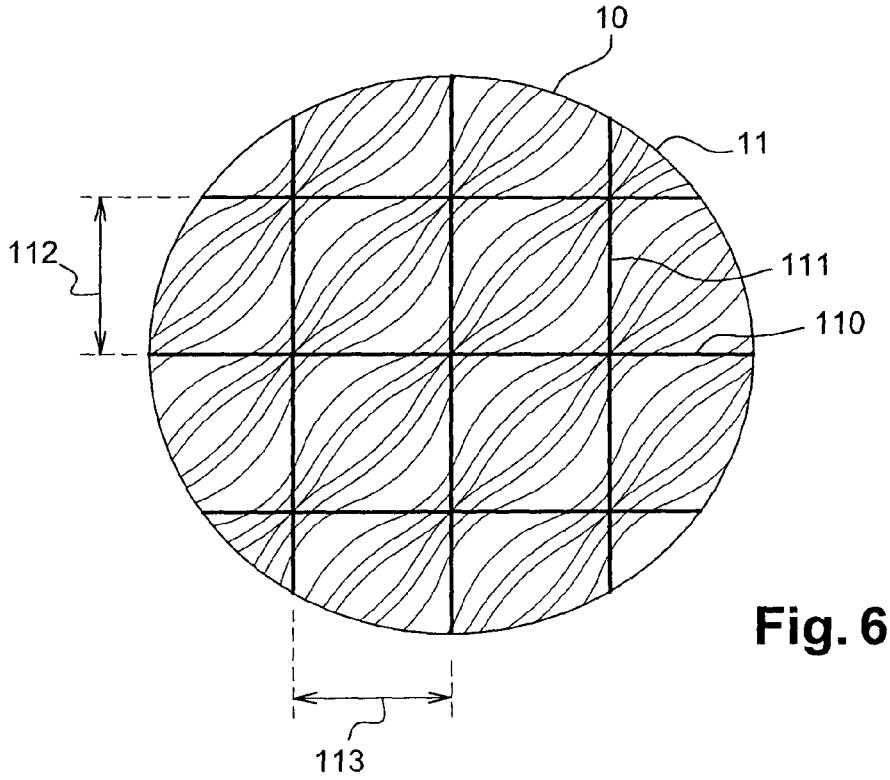

In the case where the magnets 10 and 11 are obtained from a flexible sheet, in which lines that are parallel to one another are formed, which includes permanently-oriented magnetized particles, for example sheets known as FLEXAM® sold by the French company Arelec, it is possible to observe at least the two patterns of field lines represented in FIGS. 5 and 6, when the magnets 10 and 11 are superposed.

For example, the magnets 10 and 11 are obtained by mixing highly charged strontium ferrite powders with a synthetic elastomer. They are, for example, obtained from a blend that is extruded or calendered as thin sheets having opposite faces that are perfectly smooth and parallel to one another. The sheets have a Shore D hardness between 60 and 65.

In FIG. 5, the lines of magnetic particles 110, or magnetic lines 110, of the first magnet 10 are superposed on those 111 of the second magnet 11, and in this case the pattern generated by the magnetization device 8 will have several patterns of field lines substantially parallel to one another.

On the other hand, in FIG. 6, the magnetic lines 110 of the first magnet 10 are positioned at a right angle relative to those 111 of the second magnet 11, and in this case the pattern generated by the magnetization device will have field lines that form undulations or arabesques. The observed amplitude of the undulations is dependent on the respective magnetic forces of each of the magnets. When the difference in power between the two sheets is large, the weakest magnetic field is barely represented within the overall magnetic field created by the magnetization device, and in this case the undulations are of small amplitude.

In the case where the magnetic magnets have the same force, the one which is located at the back has a tendency to have less importance in the overall pattern of the magnetization device. In the invention, magnets of different magnetic force are preferably chosen, the one with lower magnetic force being positioned so as to form the outer face, or front face, of the magnetization device. The difference between the magnetic forces of the magnets is preferably chosen to be less than 10 g/cm$^2$.

The magnetic sheets according to the invention have a thickness which is correlated to their magnetic force. The thicker the sheet is, the greater the pitch between two parallel magnetic lines may be, and the greater the magnetic force generated is. For example, the magnetic force may be measured by the magnetic pull method.

In the invention, the following combination of magnets will, for example, be produced: the first magnet 10 is in the form of a sheet of magnet having a thickness of 4/10 mm, with a pitch 112 between its magnetic lines 110 of 1 mm, and is placed side by side with the second magnet 11 which is in the form of a sheet of magnet having a thickness of 5/10 mm, with a pitch 113 between its magnetic lines 111 of 2 mm.

Figures 10A, 10B:
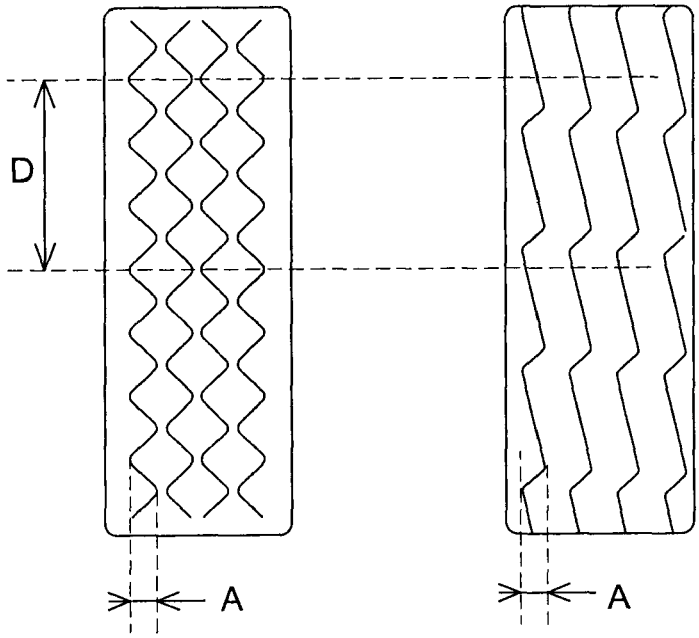
FIGS. 10*a* and 10*b*: schematic top views of magnetic lines resulting from the interference between the two magnets according to two possible configurations of a magnetization device of an assembly according to the invention.

In a first configuration of this magnetization device, the result of which is represented in FIG. 10*a*, the lines of the two magnets are arranged so that they are perpendicular to one another in order to obtain a "plaited" pattern. In a second configuration of this magnetization device, the result of which is represented in FIG. 10*b*, the respective lines of the two magnets are at 45° to one another in order to obtain a "wave" pattern. In the "plaited" pattern the undulations are more frequent, when they are observed along an identical distance D of the resulting field pattern generated by the magnetization device, and have greater amplitudes A than those obtained in the "wave" pattern.

Depending on the distance D1 between the two magnets that are parallel to one another, the pattern of field lines generated by the magnetization device is more or less blurred. Specifically, the larger D1 is, the less the pattern of the field lines observed from one side of the magnetization device will take into account the interference produced by the magnet located furthest from the other side. In order to obtain a pattern that is as clear as possible, linked to the interference between the two magnets, the distance D1 is preferably chosen so that it is less than 5/10 mm and preferably less than 3/10 mm. In certain embodiments, the distance D1 may be zero. In the first embodiment described that corresponds to FIGS. 3*a* and 3*b*, the distance D1 corresponds to the thickness of the first double-sided adhesive film 100.

Only the elements of the embodiment variants described below, that are different from the elements of the embodiments described above, will be described. Similar references, with the addition of a prime symbol, have been attributed to elements of the embodiment variants similar to the elements of the embodiment described above.

In the example represented in FIG. 4, that corresponds to a first embodiment variant, the first magnet 10' is firmly attached to the wall 12'. It is for example bonded to it. The first magnet 10' and also the wall 12' are passed through by a pivot 19 firmly attached to the second magnet 11'. This pivot 19 is free to rotate through a first orifice 20 formed in the first magnet 10' and free to rotate relative to a second orifice 21 of the wall 12'. This second orifice 21 does not necessarily emerge from both sides of the wall 12'. In the example represented in FIG. 4, the second orifice 21 emerges from both sides of the wall 12'.

The pivot 19 stands out, for example, on a plate 22 bearing the second magnet 11, in order to make this plate 22, and therefore the second magnet, rotatably movable relative to the first magnet 10'. The second magnet 11' is for example bonded to the plate 22. According to this first embodiment variant, it is the second magnet which constitutes the front face of the magnetization device.

As a variant, the pivot 19 may cooperate directly with the wall 12', without passing through the first magnet, it then stands out at the periphery of this first magnet 10'.

In the case where the magnets are movably mounted relative to one another as is the case in the embodiments represented in FIGS. 4, 7, 8 and 9, the respective positions of the second magnet 11' relative to the first magnet 10' may be indexed. For this purpose, the pivot 19 may comprise reliefs capable of cooperating with a finite number of complementary reliefs, for example made in the wall 12', in order to index a finite number of relative positions. In order to facilitate the movement of the second magnet 11', the plate 22 may be equipped with a knob 23 that facilitates the handling. This knob 23 may comprise a stop in order to cooperate with an integument of a finger when the substrate to be decorated is a nail.

Figure 7:
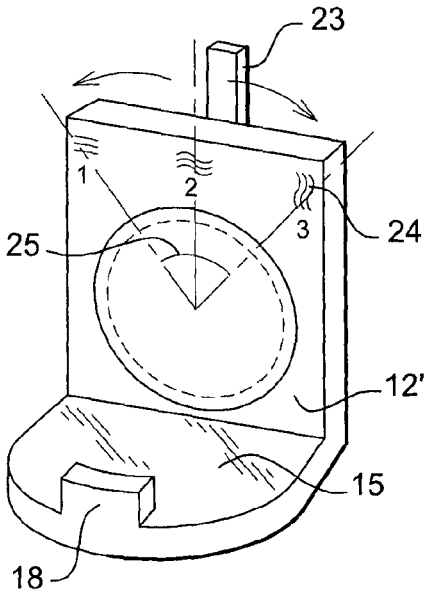
FIG. 7: a perspective front view of a second embodiment variant of a magnetization device of an assembly according to the invention.

In the second embodiment variant, in FIG. 7, unlike in FIG. 4, there is no pivot 19. The rotation of the plate 22 is permitted inside a housing of circular circumference formed in the wall 12', at the back of the first magnet 10'. In this case, the plate 22 also has a circular circumference. The plate 22 may be held by snap-fastening in the housing, but be free to rotate. In this case, it is the plate 22 which bears reliefs for cooperating with a finite number of complementary reliefs formed in the circumference of said housing of the wall 12', in order to index a finite number of relative positions of the magnets.

Furthermore, as is represented in FIG. 7, the wall 12' may be covered on its front face with pictograms such as 24 which will be located in the vicinity of the knob 23 for certain positions of the second magnet 11' relative to the first magnet 10'.

In the case where the two magnets respectively have field lines parallel to one another, then the rotation of the magnet relative to that which is fixed is designed so that the angular displacement of the second magnet 11' relative to the first is limited to an angle 25 of around 90°.

Figure 8:
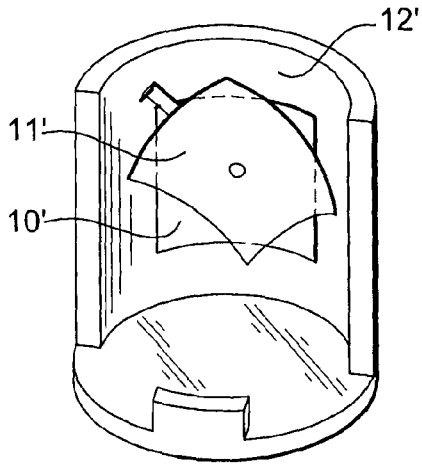
FIG. 8: a front perspective view of a third embodiment variant of a magnetization device of an assembly according to the invention.

In a third particular embodiment described in FIG. 8, the wall 12' has a curved face in order to adapt to the convex profile of the upper surface of a nail that forms the substrate to be decorated. At least the second magnet 11', which is movable relative to this wall 12', is made from a flexible sheet in order to allow its rotation or its translation relative to this wall, while conforming it to the shape of this wall, regardless of the position taken up. In this case, the second magnet 11' is mounted on a plate 22 which is itself flexible in order to allow said conformation.

In the embodiments where only the second magnet 11' can move relative to the wall 12', it is possible to choose to produce the second magnet from a flexible sheet, whilst the first magnet is produced conventionally, for example with a permanent magnet. The permanent magnets may be replaced by at least one electromagnet.

Figure 9:
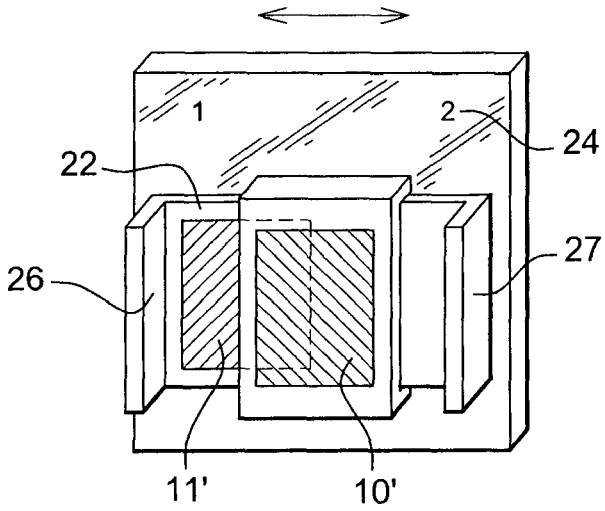
FIG. 9: a front perspective view of a fourth embodiment variant of a magnetization device of an assembly according to the invention.

As a variant, according to a fourth embodiment of a magnetization device according to the invention, represented in FIG. 9, the first magnet 10', fixed relative to the wall 12', is the one which is the outermost of the magnetization device and therefore the magnet which will be brought closest to the substrate to be decorated. In this embodiment, the plate 22 bearing the second magnet 11' is slidably mounted between the wall 12' and the first magnet 10'. In this exemplary embodiment, relative positions of the second magnet 11' relative to the first magnet 10' may be provided such that the two magnets are not completely superposed. The plate 22 preferably comprises two opposite lateral reinforcements 26 and 27 for favouring the indexing of at least two relative end positions of the second magnet 11' relative to the first.

In one preferred mode of use of any embodiment variant according to the invention of a magnetization device, the substrate covered with a film of fluid composition comprising magnetic substances is brought into the vicinity of this device. The greater the tendency of the composition to set rapidly, namely in less than 1 minute after depositing the film, the more it will be necessary to shorten the period of time elapsed between depositing said film and its exposure to the magnetic field. When the composition sets in less than 1 minute, a relative position of the second magnet relative to the first is chosen beforehand.

The effectiveness of the magnetization device is a function of a defined distance D2 between the substrate covered with its film and the magnet which may be presented closest to the substrate. In particular, the spatial configuration of the second portion 15 and the positioning stop 18 are chosen so that this distance D2 is preferably between 0.3 and 3 mm, in particular of around 1 mm.

The magnetic power of a magnet is less than 2000 Gauss when the magnet is made from a flexible sheet. In particular, its magnetic power is around 1300 G.

The higher the viscosity of the composition spread in a film over the substrate, the more the magnetic substances included in the film will be subjected to a resistance preventing them from moving along the magnetic field lines to which they will be subjected. Thus, the higher the viscosity of the composition, the more important it is to place the film in the vicinity of the magnetization device, and therefore to choose a position in which the film is at a distance D2 close to its lower limit. When the viscosity of the composition at 25° C. is greater than 0.6 Pa·s, the magnetization device is designed so that the distance D2 is not zero and is less than 1 mm.

Viscosity Measurement

The viscosity of the composition is measured at 25° C. using a Rheomat 180 (Lamy) equipped with an MS-R1, MS-R2, MS-R3, MS-R4 or MS-R5 spindle chosen as a function of the consistency of the composition, that rotates at a rotational speed of 200 rpm. The measurement is taken after 10 min of rotation. The viscosity measurements are carried out at most 1 week after manufacture of the composition.

Throughout the description, the expression "comprising one" should be considered as being synonymous with "comprising at least one", unless otherwise indicated.

Obviously, numerous modifications and variations of the present invention are possible in light of the above teachings. It is therefore to be understood that within the scope of the appended claims, the invention may be practiced otherwise than as specifically described therein.

What is claimed:

1. An assembly comprising:

a container that contains a fluid composition having magnetic substances and a magnetization device that makes it possible to produce a pattern on a substrate onto which said composition has been deposited, the magnetization device including:

a holder; and two magnets, wherein at least one of the magnets is in the form of a flexible sheet, wherein the two magnets are at least partially superposed so that the field lines that they generate in combination with one another result from the interference between the field lines of each of the magnets, wherein the magnetization device has a concave front face, wherein the magnet in the form of a flexible sheet forms a front face of the magnetization device intended to be placed closest to the substrate, and wherein the magnet forming the front face has a concave shape substantially similar to the concave front face of the magnetization device.

2. The assembly according to claim 1, wherein the magnet having a lower magnetic power among the two magnets is positioned so as to form a front face of the magnetization device intended to be placed closest to the substrate.

3. The assembly according to claim 1, wherein the concave front face includes at least one peak where the radius of curvature is between 4 and 20 mm.

4. The assembly according to claim 1, wherein the two magnets are arranged so as to allow modifications of the field lines that they generate in combination with one another, one of the two magnets being movable relative to the other of the two magnets.

5. The assembly according to claim 4, wherein a first magnet is held at a fixed position relative to the holder.

6. The assembly according to claim 4, wherein a second magnet is movably mounted about an axis of rotation relative to the holder.

7. The assembly according to claim 1, wherein the holder includes a fastening means in order to be retained on the container having the composition.

8. The assembly according to claim 1, wherein the container is a bottle equipped with a neck and the holder includes an opening in order to fit around the neck.

9. The assembly according to claim 1, wherein one of the magnets is multipolar.

10. The assembly according to claim 1, wherein the two magnets are in flexible sheet form and are multipolar.

11. The assembly according to claim 1, wherein the magnet in the form of a flexible sheet is formed by the inclusion of magnetized particles in a sheet made from a thermoplastic or from a resin.

12. The assembly according to claim 11, wherein the magnetized particles are arranged so as to form lines in the holder.

13. The assembly according to claim 1, wherein the assembly includes an applicator mounted so as to be firmly attached to a closure member of the container, the closure member configured to cooperate with the magnetization device in order to keep the magnetization device firmly attached to the container.

14. The assembly according to claim 1, wherein the magnet having a lower magnetic power among the two magnets is positioned so as to form a front face of the magnetization device intended to be placed closest to the substrate.

15. A method for decorating a substrate using an assembly having a container that contains a fluid composition having magnetic substances and a magnetization device that makes it possible to produce a pattern on a substrate onto which said composition has been deposited, the magnetization device including a holder and two magnets, at least one of the magnets is in the form of a flexible sheet, the two magnets being at least partially superposed so that the field lines that they generate in combination with one another result from the interference between the field lines of each of the magnets, the magnetization device having a concave front face, the magnet in the form of a flexible sheet forms a front face of the magnetization device intended to be placed closest to the substrate, and the magnet forming the front face has a concave shape substantially similar to the concave front face of the magnetization device, the method comprising:

depositing a film of fluid composition on the substrate, the substrate being a keratin material or a part intended to form one of a primary or secondary packaging of said assembly; and subjecting the deposited film to the magnetic field generated by the magnetization device before solidification of the film.

16. The method according to claim 15, wherein the magnet in the form of a flexible sheet was previously embossed before its incorporation into the magnetization device so as to have the concave front face.

17. The method according to claim 15, wherein the keratin material is one of a nail, the skin, and a mucosa, wherein the mucosa is a lip.

* * * * *